US009284165B2

(12) United States Patent
Willim

(10) Patent No.: US 9,284,165 B2
(45) Date of Patent: Mar. 15, 2016

(54) METHOD OF MOVING LARGE CRANES IN THE SETUP SYSTEM AND SYSTEM OF CARRYING OUT THIS METHOD

(75) Inventor: Dipl.-Ing. Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 16 days.

(21) Appl. No.: 13/157,400

(22) Filed: Jun. 10, 2011

(65) Prior Publication Data

US 2011/0303628 A1 Dec. 15, 2011

(30) Foreign Application Priority Data

Jun. 10, 2010 (DE) ..... 10 2010 023 275

(51) Int. Cl.
*B66C 23/36* (2006.01)
*B66C 23/82* (2006.01)

(52) U.S. Cl.
CPC ..... *B66C 23/36* (2013.01); *B66C 23/82* (2013.01)

(58) Field of Classification Search
CPC ..... B66C 23/36; B66C 23/365; B66C 23/38; B66C 23/40; B66C 23/42; B66C 23/46; B66C 23/34; B66C 23/50; B66C 23/72; B66C 23/74; B66C 23/76; B66C 23/82; B66C 23/344
USPC ..... 212/294
See application file for complete search history.

(56) References Cited

U.S. PATENT DOCUMENTS

| | | | | |
|---|---|---|---|---|
| 3,822,791 | A | 7/1974 | Eiler | |
| 3,929,204 | A * | 12/1975 | Newell | 212/301 |
| 4,449,635 | A * | 5/1984 | Helm et al. | 212/196 |
| 4,524,875 | A * | 6/1985 | Jamieson | B66C 23/60 212/239 |
| 4,700,851 | A * | 10/1987 | Reeve | B66C 23/36 212/175 |
| 5,282,714 | A * | 2/1994 | Diebolt | B66C 23/86 212/245 |
| 6,631,817 | B1 * | 10/2003 | Fleagle et al. | 212/301 |
| 7,637,512 | B1 * | 12/2009 | McGhie et al. | 280/93.504 |
| 2002/0066710 | A1 * | 6/2002 | Spitsbergen | 212/179 |

FOREIGN PATENT DOCUMENTS

| | | | |
|---|---|---|---|
| DE | 1280519 | A | 10/1968 |
| DE | 2140233 | A1 | 2/1973 |
| DE | 202006015189 | U1 | 2/2008 |

OTHER PUBLICATIONS

EPO Machine Translation of DE 202006015189.

* cited by examiner

*Primary Examiner* — Michael Mansen
*Assistant Examiner* — Nathaniel Adams
(74) *Attorney, Agent, or Firm* — The PL Law Group, PLLC

(57) ABSTRACT

The present invention relates to a method of moving a large mobile crane having a luffable boom system. In accordance with the invention, the boom system is luffed down into a largely horizontal position for moving and is supported on a support block of a construction machine or of a small mobile crane so that the large mobile crane can be moved together with the construction machine or the small mobile crane. The invention further relates to a system for carrying out the aforesaid method.

9 Claims, 1 Drawing Sheet

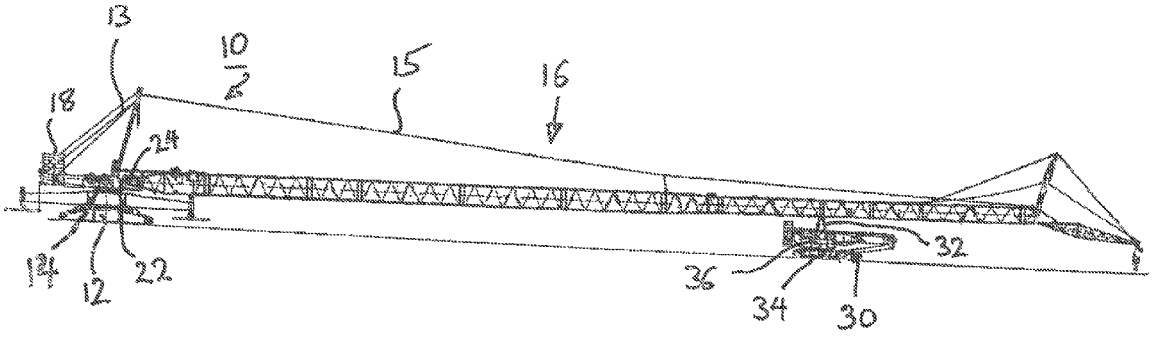
13
10
2
15
16
18
24
14
12
22
36
34
30
32

METHOD OF MOVING LARGE CRANES IN THE SETUP SYSTEM AND SYSTEM OF CARRYING OUT THIS METHOD

CROSS-REFERENCE TO RELATED APPLICATION AND CLAIM OF PRIRITY

This application claims the benefit of German Utility Model Application No. 10 2010 023 275.0, filed on Jun. 10, 2010, in the German Patent and Trademark Office, the disclosures of which are incorporated herein in their entirety by reference.

BACKGROUND

1. Field of the Invention

The present invention relates to a method of moving a large mobile crane in accordance with the preamble of claim 1 and to a system of carrying out said method.

2. Description of the Related Art

Large mobile cranes are frequently used today in the assembly of wind turbines. In this respect, lifting heights of considerably more than 150 m are required. The lifting work is very frequently carried out by crawler-mounted cranes having lattice booms. Such mobile cranes are very complicated and/or expensive to set up, but have the advantage after being set up that they can be moved in the terrain at the construction site. Only slightly prepared travel paths thus have to be established.

Since very frequently not only one wind turbine has to be assembled, but very many wind turbines after one another in the establishing of a wind farm, it would be desirable to move the respective mobile crane from assembly site to assembly site in the setup state. A problem in the moving of the fully setup mobile crane is formed, however, by the erected long booms. They increase the height of the overall center of mass during movement, which can already result in the tilting of the total mobile crane on a slight inclination of the mobile crane in uneven terrain.

SUMMARY

It is therefore the object of the invention to provide a method by means of which a large mobile crane can be moved with together with its full boom system from deployment site to deployment site on the construction site without having to dismantle and reassemble the boom system every time.

According to an aspect of the present invention, a method of moving a large mobile crane having an undercarriage, having a superstructure rotatably supported thereon via a slewing gear with at least one boom system arranged thereat luffable about a luffing axis, characterized in that the boom system is luffed down for moving in a largely horizontal direction and is supported on a support block of a construction machine or of a small mobile crane; and in that the large mobile crane is moved together with the construction machine or the small mobile crane.

According to an embodiment of the present invention, the slewing gear of the large mobile crane may be switched free; and/or in that, on the use of a small mobile crane, its slewing gear is switched free.

According to an embodiment of the present invention, for setting the total center of gravity of the superstructure, a specific residual tension may be introduced in a defined manner from the boom system into the superstructure of the large mobile crane.

According to an embodiment of the present invention, on the use of a lattice boom as the boom system or of a telescopic boom having a guying block and an adjustment rope assembly, the residual tension may be introduced via the existing adjustment rope assembly.

According to an embodiment of the present invention, on the use of a telescopic boom having a luffing cylinder as the boom system, the lowering brake may be switched free, a constant pressure is preset in the luffing cylinder and a float switch is preset.

According to an embodiment of the present invention, the boom system includes a main boom having a boom guying with guying blocks and, selectively, additionally with adapters, with a boom extension and/or with a fly boom.

According to an embodiment of the present invention, the construction machine or the small mobile crane may have a support block with mounting means for mounting the boom system.

According to an embodiment of the present invention, a crawler-mounted crane with a lattice boom, a wheeled mobile crane with a telescopic boom, a crawler-mounted crane with a telescopic boom or a wheeled mobile crane with a lattice boom may be used as a large mobile crane.

BRIEF DESCRIPTION OF THE DRAWING

A more complete appreciation of the invention, and many of the attendant advantages thereof, will be readily apparent as the same becomes better understood by reference to the following detailed description when considered in conjunction with the accompanying drawing in which like reference symbols indicate the same or similar components, wherein:

FIG. 1 shows a schematic side view of a mobile crane in accordance with an embodiment of the present invention.

DETAILED DESCRIPTION

Accordingly, a method is provided of moving a large mobile crane having an undercarriage, a superstructure supported rotatably thereon via a slewing gear and with at least one boom system arranged thereat luffable about a luffing axis, wherein the boom system is luffed down into a largely horizontal position for moving and is supported on a support block of a construction machine or of a small mobile crane so that the large mobile crane is moved together with the construction machine or the small mobile crane. Preferred embodiments of the invention result from the subordinate claims dependent on the main claim.

It is accordingly advantageous if the slewing gear of the large vehicle crane is switched free. The construction machine or the small mobile crane can thus rotate the boom system and the superstructure of the large mobile crane by a corresponding movement. Alternatively or additionally, on the use of a small mobile crane, its slewing gear can also be switched free. The undercarriage of the small mobile crane can thus rotate about the system superstructure of the small mobile crane and boom of the large mobile crane.

On the erecting of wind turbines in wind parks, large crawler-mounted cranes are frequently used in the form of narrow-track gauge cranes such as are described in DE 203 05 683 U1. Here, the tilt edges in the crawler direction are further remote from the axis of rotation of the superstructure than perpendicular to the crawler direction. The risk of tilting on the rotating of the superstructure and of the ballast is larger in the latter case. To prevent this risk of tilting overall, it must be ensured that the total center of gravity of the superstructure is always within the base quadrilateral. A specific residual tension of the boom system is now advantageously introduced into the superstructure of the large mobile crane to set the total center of gravity of the superstructure.

If now a lattice boom is used as the boom system or a telescopic boom with a guying block and an adjustment rope assembly or a derrick boom, in accordance with a further preferred embodiment of the invention, the residual tension which has to be provided for the displacement of the total center of gravity of the superstructure can be introduced by the existing adjustment rope assembly.

If now a telescopic boom having a luffing cylinder is used as the boom system, the lowering brake present in this telescopic boom is switched free to apply a residual tension and a constant pressure is preset in the luffing cylinder, with simultaneously a float switch being preset.

The invention further relates to a system for carrying out the aforesaid method in accordance with the invention. Accordingly, the boom system of the large mobile crane includes a main boom having, optionally, a boom guying assembly with guying blocks and selectively additionally having adapters, having a boom extension and/or having a fly boom.

If now a small mobile crane is used to support the total boom system, said mobile crane has, in accordance with a further embodiment of the system, a support block with mounting means for mounting the boom system. Instead of a small mobile crane, however, a powerful construction machine can also be used having a corresponding support block with mounting means for mounting the boom system if such a powerful construction machine is anyway used on the construction site so that no separate small mobile crane has to be provided to move the large mobile crane.

The mounting means of the support block can be designed so that they can largely transmit vertical forces. In this case, on use of an adjustment rope assembly, this adjustment rope assembly is released so much that correspondingly present guying bars just sag "slackly". In this state, the total weight of the boom systems is on the support block which is respectively set up on the small mobile crane or on the powerful construction machine. The support block is naturally preferably coupled to the placed-on boom system for moving.

In the system, alternatively a crawler-mounted crane with a lattice boom, a wheeled mobile crane with a telescopic boom (typically a mobile crane in an all-terrain design), a crawler-mounted crane with a telescopic boom or a wheeled mobile crane with a lattice boom can be used as a large mobile crane.

Further features, details and advantages of the invention will be described in more detail with reference to an embodiment shown in the drawing.

FIG. 1 shows a schematic side view of a mobile crane in accordance with the invention during the movement on the terrain.

FIG. 1 shows a mobile crane 10 in accordance with an embodiment of the present invention. This mobile crane is a large crawler-mounted crane which includes in a usual manner an undercarriage 12 and a superstructure 14 which is rotatably supported via a slewing gear 22 on an undercarriage 12 and which is rotatable in a known manner via a slewing gear 22. A luffable boom system 16 which includes a lattice boom with fly boom in the present case is pivotally connected to the superstructure 14 via a luffing axle 24.

The crawler-mounted crane 109 shown here can be moved together with its total boom system 16. In this respect, the ballast 18 remains fully or at least partly fastened to the crawler-mounted crane. In FIG. 1, the large mobile crane made as a crawler-mounted crane 10 is shown during its movement from a first deployment site to a second deployment site. For this purpose, to keep the center of gravity low, the boom system 16 is luffed down into a largely horizontal position, as is shown in FIG. 1. On the luffing down, a large to full ballast load and a support are necessary. For this purpose, a small mobile crane 30, which is likewise a crawler-mounted crane here, is positioned at a defined point with respect to the boom system of the large crawler-mounted crane 10 before the luffing down. The small crawler-mounted crane 30 has a support block 32 on which the boom system 16 is supported on the support block 32 after the luffing down. During the movement of the large crawler-mounted crane 10, the slewing gear likewise present at the small crawler-mounted crane 30 is likewise switched free. The undercarriage 34 of the small crawler-mounted crane 30 can thus rotate about the system superstructure of the small crawler-mounted crane 30 and the boom 16 of the large crawler-mounted crane 10.

The mounting means of the support block 32 are formed, in accordance with an embodiment not shown in any more detail here, such that they can predominantly transmit vertical forces. The adjustment rope assembly 13 of the large crawler-mounted crane 10 is released so much that the guying bars 15 of the large crawler-mounted crane 10 just sag "slackly". In this state, the total weight of the boom system is on the small crawler-mounted crane 30 and on the luffing axle 24 of the superstructure 14 of the large crawler-mounted crane 10.

For moving, the slewing gear of the large crawler-mounted crane 10 is switched free—The small crawler-mounted crane 30 can thus rotate the boom system 16 and the superstructure 14 of the large crawler-mounted crane about its track drive. If the longitudinal axes of both tracks, i.e. the tracks of the large crawler-mounted crane 10 and the tracks of the small crawler-mounted crane 30, are aligned in the same direction, as is shown in FIG. 1 here, the total system can be moved. A change in direction of the tracks of the large crawler-mounted crane takes place in a known manner, as was described, for example, in DE 203 05 683 for a narrow-gauge crawler-mounted crane. Since a risk of tilting is no longer present due to the support on the small crawler-mounted crane 30, the change in direction could also take place in a manner known for crawler-mounted cranes of normal widths. This would then represent the speed differences between the crawler tracks of the large crawler-mounted crane 10.

Instead of the small crawler-mounted crane 10 with a corresponding support block 11 shown in the present embodiment, another powerful construction machine which is present at the construction site could also be retrofitted with a corresponding support block 11 so that it can be used for supporting the boom system 16 during the movement instead of the small crawler-mounted crane 30.

While the invention has been described in terms of what is presently considered to be the most practical and preferred Embodiments, it is to be understood that the invention needs not be limited to the disclosed Embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A method of moving a large mobile crane having an undercarriage, having a superstructure rotatably supported thereon via a slewing gear with at least one boom system arranged thereat luffable about a luffing axis, characterized in that the boom system is luffed down for moving in a largely horizontal direction and is supported on a support block of a small mobile crane having a slewing gear; and in that the large mobile crane is moved together with the small mobile crane.

2. A method in accordance with claim 1, characterized in that the slewing gear of the large mobile crane is switched free, and the slewing gear of the small mobile crane is switched free.

3. The method in accordance with either of the claim 1, wherein the small mobile crane is a crawler-mounted crane.

4. A method in accordance with claim 1, characterized in that, for setting the total center of gravity of the superstructure, a specific residual tension is introduced in a defined manner from the boom system into the superstructure of the large mobile crane.

5. A method in accordance with claim 4, characterized in that, on the use of a lattice boom as the boom system or of a telescopic boom having a guying block and an adjustment rope assembly, the residual tension is introduced via the adjustment rope assembly.

6. A method in accordance with claim 4, characterized in that, a telescopic boom has a luffing cylinder which is used as the boom system, and when the telescopic boom is operated as the boom system, the lowering brake is switched free, a constant pressure is preset in the luffing cylinder and a float switch is preset.

7. A method in accordance with claim 1, characterized in that the boom system comprises a main boom having a boom guying with guying blocks and, at least one of adapters, a boom extension, and a fly boom.

8. A method in accordance with claim 7, characterized in that the small mobile crane has a support block on which the boom system is supported.

9. A method in accordance with the claim 7, characterized in that a crawler-mounted crane with a lattice boom, a wheeled mobile crane with a telescopic boom, a crawler-mounted crane with a telescopic boom or a wheeled mobile crane with a lattice boom is used as the large mobile crane.

* * * * *